US012151848B2

(12) United States Patent
Martin

(10) Patent No.: US 12,151,848 B2
(45) Date of Patent: Nov. 26, 2024

(54) HOLLOW GLASS CONTAINER HAVING A SPECIFIC LIP PROFILE

(71) Applicant: VERALLIA PACKAGING, Courbevoie (FR)

(72) Inventor: Eric Martin, Fontenay aux Roses (FR)

(73) Assignee: VERALLIA PACKAGING, Courbevoie (FR)

( * ) Notice: Subject to any disclaimer, the term of this patent is extended or adjusted under 35 U.S.C. 154(b) by 0 days.

(21) Appl. No.: 18/023,926

(22) PCT Filed: Sep. 2, 2021

(86) PCT No.: PCT/FR2021/051510
§ 371 (c)(1),
(2) Date: Feb. 28, 2023

(87) PCT Pub. No.: WO2022/049348
PCT Pub. Date: Mar. 10, 2022

(65) Prior Publication Data

US 2023/0322431 A1 Oct. 12, 2023

(30) Foreign Application Priority Data

Sep. 4, 2020 (FR) ..... 20/08973

(51) Int. Cl.
*B65D 1/40* (2006.01)
*B65D 1/10* (2006.01)

(52) U.S. Cl.
CPC *B65D 1/40* (2013.01); *B65D 1/10* (2013.01)

(58) Field of Classification Search
CPC ..... B65D 1/10; B65D 41/0457; B65D 1/40; B65D 2501/0081; B67B 3/14; B67B 3/18
USPC ..... 206/674; 220/289
See application file for complete search history.

(56) References Cited

U.S. PATENT DOCUMENTS 3,182,843 A * 5/1965 Foye ..... B65D 41/0471 215/337
3,270,904 A * 9/1966 Curry ..... B65D 41/0435 215/346
3,300,072 A * 1/1967 Caviglia ..... B65D 41/12 215/345
3,411,651 A * 11/1968 Mumford ..... B65D 41/0457 215/348
3,741,423 A * 6/1973 Acton ..... B65D 41/0457 215/346

(Continued)

FOREIGN PATENT DOCUMENTS

DE 203 21 416 U1 4/2007
FR 2 748 732 A1 11/1997

(Continued)

OTHER PUBLICATIONS

English translation of FR 2900143 (Year: 2006).*

(Continued)

*Primary Examiner* — Steven A. Reynolds
*Assistant Examiner* — Prince Pal
(74) *Attorney, Agent, or Firm* — Oliff PLC

(57) ABSTRACT

A glass hollow container including a finish intended to cooperate with a cap with notches to close the container, wherein the finish has a locking ring whose cross section has a profile substantially in the shape of an ogive.

13 Claims, 4 Drawing Sheets

(56) References Cited

Figure 1:
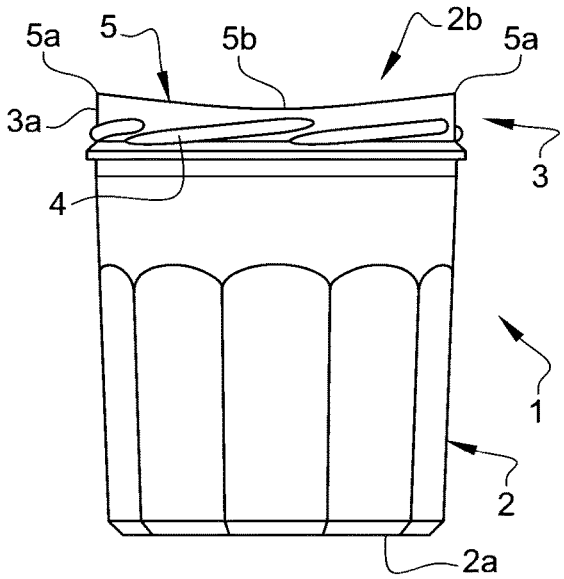
Fig. 1 PRIOR ART

U.S. PATENT DOCUMENTS 3,794,200 A * 2/1974 Marks ..... B65D 50/06 215/44
3,858,743 A * 1/1975 Mumford ..... B65D 41/0457 215/329
4,373,641 A * 2/1983 Banich, Sr. ..... B65D 41/0471 215/331
4,562,930 A * 1/1986 Lecinski, Jr. ..... B65D 41/0457 315/318
4,629,084 A * 12/1986 Hackelsberger ..... B65D 51/14 206/508
4,640,430 A * 2/1987 Haines ..... B65D 41/04 215/330
5,489,036 A 2/1996 Arkins
6,015,054 A * 1/2000 King ..... B65D 51/28 215/44
7,562,783 B2 * 7/2009 Bourreau ..... B65D 53/06 215/21
7,922,019 B2 * 4/2011 Granger ..... B21D 51/50 215/349
9,278,784 B2 * 3/2016 Wood ..... B67B 6/00
10,150,596 B2 * 12/2018 Di Giuseppantonio ..... B65D 51/145
10,399,728 B2 * 9/2019 Brozell ..... B65D 1/0246
10,683,145 B2 * 6/2020 Irizar Gonzalez . B65D 43/0231
10,759,559 B2 * 9/2020 Kraft ..... B65D 1/0246
11,643,254 B2 * 5/2023 Fink ..... B65D 41/17 53/488
2003/0021919 A1 * 1/2003 Granger ..... B65D 41/0428 428/34.1
2007/0095782 A1 * 5/2007 Granger ..... B65D 41/045 215/354
2009/0212060 A1 * 8/2009 Shinohara ..... B65B 7/285 220/661
2012/0037589 A1 * 2/2012 King ..... B65D 41/0421 215/329
2020/0156139 A1 * 5/2020 Ross ..... B67B 3/18
2023/0249865 A1 * 8/2023 Fanton ..... B05B 11/1047 215/44

FOREIGN PATENT DOCUMENTS

FR 2 900 143 A1 10/2007
GB 2 330 133 A 4/1999

OTHER PUBLICATIONS

Oct. 18, 2021 Search Report issued in International Patent Application No. PCT/FR2021/051510.
Mar. 7, 2023 International Preliminary Report on Patentability issued in International Patent Application No. PCT/FR2021/051510.

* cited by examiner

HOLLOW GLASS CONTAINER HAVING A SPECIFIC LIP PROFILE

The present invention relates to a glass hollow container comprising a finish having a specific locking ring profile.

In the field of glass hollow containers, the locking ring designates the upper part of the finish forming the opening of the container.

The packaging of products in glass hollow containers closed by notched caps, such as for example conventional jam jars, has the disadvantage of sometimes generating very high opening torques which are difficult to overcome by certain users, for example by the elderly or by people with little strength in their hands. This phenomenon may be accentuated over time or when the containers, for example jars, are stored under a vertical load.

In general, the notched caps intended to close these containers have a circular groove at the bottom of which there is a seal. When the container is closed, this seal is intended to compress on the locking ring of the finish forming the opening of the container.

The high value of the opening torque necessary to open the conventional containers may be due to the fact that the current geometries of container finish and cap allow free compression of the seal. This compression of the seal may lead to excessive deformation of the latter, also called punching of the seal. It may also lead to an increase in the surface in contact between the locking ring and the seal. Consequently, the tribological constraint to be overcome in order to open the container is aggravated.

The excessive compression of the seal may be produced continuously over its entire circularity, by excessive tightening of the cap on the finish of the container. This excessive compression may also materialize locally, due to geometrical deviations from the finish flatness, also called veil. If these geometrical deviations are significant, they can lead to a deformation of the locking ring in the shape of a "horse saddle": in other words, the locking ring has two diametrically opposed high points (peaks), and two diametrically opposed low points (valleys), located at 90° from the two high points.

In FIG. 1, a glass hollow container 1 of the prior art is shown, for example intended for packaging jam.

The container 1 comprises a generally cylindrical body 2 having a closed lower end 2*a* forming the bottom of the container 1, and an open upper end 2*b*. The upper end 2*b* is formed by a finish 3 having an external wall 3*a* provided with threads 4 and an upper part called the locking ring 5.

Figure 2:
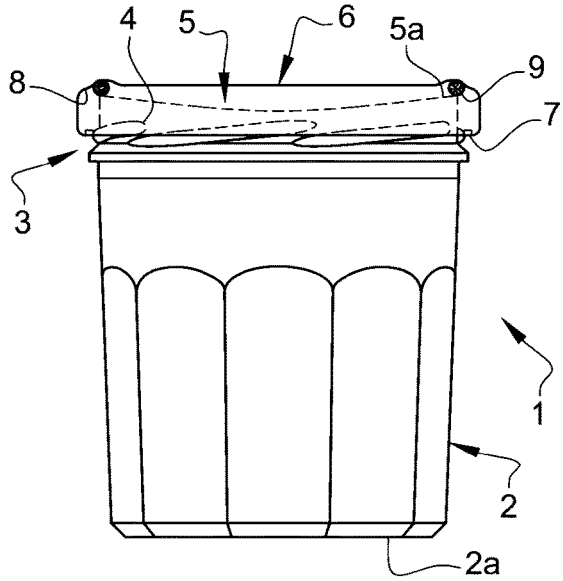
Fig. 2 PRIOR ART

With reference to FIG. 2, the container 1 of the prior art of FIG. 1 is intended to be closed in a conventional manner by means of a cap 6 having notches 7 configured to cooperate with the threads 4 of the external wall 3*a* of the finish 3 in order to screw the cap 6 onto the finish 3. The cap 6 also has a circular groove 8 at the bottom of which there is a seal 9 which is also circular. When the cap 6 is screwed onto the finish 3 of the container 1, the seal 9 is compressed on the locking ring 5.

As explained above, and as it appears from FIG. 1, the finish 3 being made of glass, the locking ring 5 may have flatness deviations, with high points 5*a* and low points 5*b*.

With reference to FIG. 2, depending on the rigidity of the used cap 6 and its diameter, the dimensional deviations of the finish 3, and in particular of the locking ring 5, expose the areas of the seal 9 which are in contact with the high points 5*a* at increased seal punching depths.

Figure 3:
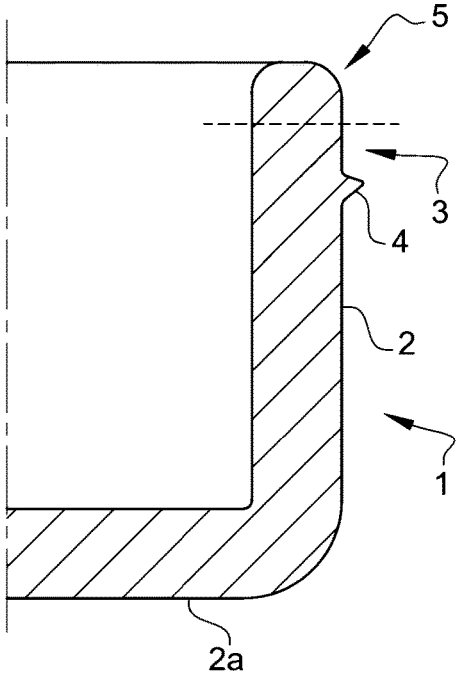
Fig. 3 PRIOR ART
Figure 4:
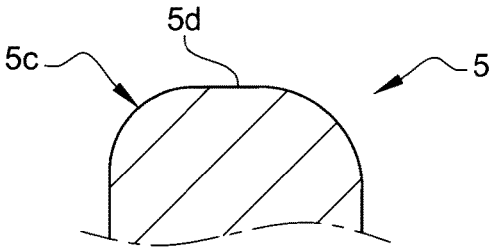
Fig. 4 PRIOR ART

With reference to FIG. 3 and FIG. 4 which are a partial view on a larger scale, the profile of a cross section of the locking ring 5 of a conventional container 1 of the prior art as shown in FIG. 1 is shown. This profile of standard locking ring 5 has the shape of an arc 5*c* which is generally close to what could be called a semicircular arc having a slight flat 5*d* at the top of the arc.

Figure 5:
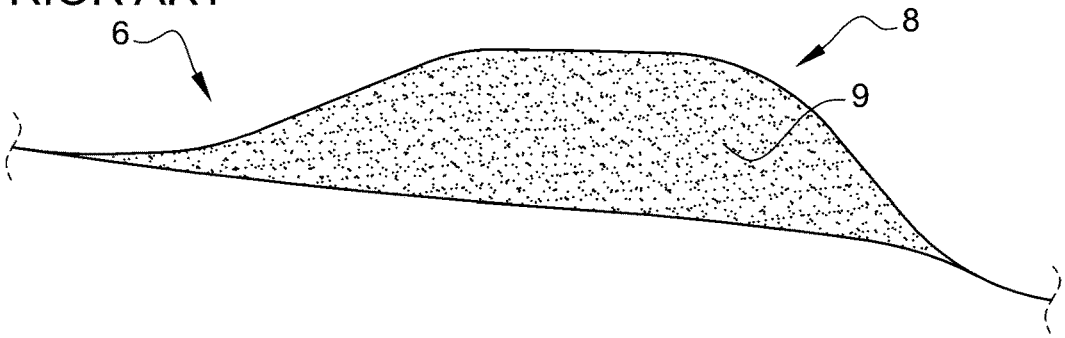
Fig. 5 PRIOR ART

With reference to FIG. 5, a cross section of a circular groove 8 of a cap 6 of FIG. 2 is shown, with the seal 9 in new condition, in other words before any use of the cap 6 for closing a container 1. The seal 9 is for example a PVC (polyvinyl chloride) cast seal.

Figure 6:
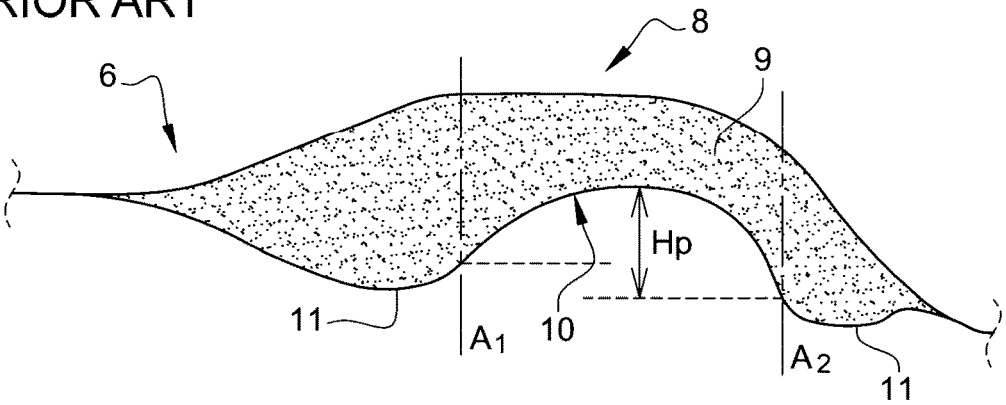
Fig. 6 PRIOR ART

With reference to FIG. 6, the cross section of the circular groove 8 and of the seal 9 of FIG. 5 is shown after the cap 6 has been screwed and tightened on a container 1 having the locking ring 5 in profile shown in FIG. 4 and the container 1 was kept closed for 7 days. As it appears from this FIG. 6, the seal 9 has been compressed by the locking ring 5 of FIG. 4 and has been deformed. The seal 9 thus has a circular arc-shaped cavity 10. As also appears from this FIG. 6, the locking ring 5, by fitting into the seal 9, has pushed material from the seal 9 on either side of the cavity 10, this material forming beads 11. Thus, for the cavity 10, a length of circular arc located between the two beads 11 corresponding to the length of contact arc (Arc) between the locking ring 5 and the seal 9 is measured. This length of contact arc (Arc) corresponds to the circular arc included between the two straight lines A1 and A2 indicated in FIG. 6. This length of contact arc is calculated after taking the profile by a feeler or by non-contact optical method. The length of contact arc corresponds to the sum of the distances calculated between the successive points involved in the area of contact locking ring/seal. In the same way, a height of this contact arc corresponding to the punching height, indicated by Hp in FIG. 6, is also measured for the cavity 10.

It has been found that the greater the punching height is, in other words the greater the value of Hp is, and/or the greater the length of contact arc (Arc) is, the greater the opening torque necessary to be able to open the container is.

Thus, there remains the need for a glass hollow container whose locking ring would make it possible to reduce the opening torque necessary to open such a container after it has been closed, potentially pasteurized or sterilized, and kept closed for a significant period, for example several months, in a storage position. The present invention aims to remedy this need by providing a glass hollow container comprising a finish having a specific locking ring profile.

The present invention thus relates to a glass hollow container comprising a finish intended to cooperate with a notched cap to close said container, characterized in that said finish has a locking ring whose cross section has a profile substantially in the shape of an ogive, said profile defining for the ogive a base having a center, two flanks, and a top, said top being aligned with a point located at the center of the base or offset in the direction of an interior of the container with respect to said point located at the center of the base.

Thus, the profile of the locking ring of the container according to the invention approximates a broken arc whose top is free of flat.

The specific profile of the locking ring of the container according to the invention makes it possible to significantly reduce the length of the contact arc between the locking ring and the seal of a cap closing the container, at a comparable punching height. For example, it has been observed that the specific profile of the locking ring of the container according to the invention makes it possible to reduce the lengths of contact arc by 27 to 60% compared to a profile of standard locking ring as shown in FIG. 4.

Thus, in one embodiment, said top has the shape of a circular arc having a radius Rs ranging from 0.10 to 1.25 mm, preferably from 0.40 to 1.00 mm. The top of the ogive is thus free of any flats. For example, Rs may be equal to 0.80 mm.

In one embodiment, the top of the ogive is aligned with a point located at the center of the base of the ogive. In such a case, the profile of the locking ring may thus define a symmetrical ogive.

In one embodiment of the invention, the profile of the locking ring of the container according to the invention defines an asymmetrical ogive, the top of the ogive being offset in the direction of the interior of the container, with respect to a point located at the center of the base of the ogive. Such an embodiment may have the advantage of more easily controlling the reflux of material from the seal of the cap onto the flanks of the locking ring during storage of the container closed. Such an embodiment also makes it possible to advantageously reduce the length of the contact arc between the locking ring and the seal of a cap closing the container, at a comparable punching height, compared to an embodiment, not according to the invention, in which the top of the ogive would be offset in the direction of the exterior of the container with respect to a point located at the center of the base of the ogive.

In one embodiment of the invention, the base of the ogive has a width Lp ranging from 1.0 mm to 10.0 mm, preferably from 2.0 mm to 6.0 mm. In one embodiment of the invention, the height Hs of the ogive, from the base to its top, ranges from 0.5 mm to 5 mm, preferably from 1.0 mm to 3.0 mm.

In one embodiment, the flank of the ogive located towards the interior of the container joins the generally rectilinear profile of an inner wall of the finish according to a circular arc having a radius Ri ranging from 0.10 mm to 1.25 mm, preferably ranging from 0.40 mm to 1.00 mm. The flank of the ogive located towards the interior of the container may itself be slightly curved or substantially rectilinear.

In one embodiment, the flank of the ogive located towards the exterior of the container joins the generally rectilinear profile of an outer wall of the finish according to a circular arc having a radius Re ranging from 0.10 mm to 1.25 mm, preferably ranging from 0.40 mm to 1.00 mm. The flank of the ogive located towards the exterior of the container may itself be slightly curved or substantially rectilinear.

The finish of the container according to the invention may also be provided on its outer wall with particular threads making it possible to limit the tightening of the cap on the container when closing the container. This limitation of the tightening of the cap also makes it possible to reduce the opening torque necessary to open the container. Thus, people with little strength in their hands may open the container according to the invention more easily.

Thus, in one embodiment, the outer wall of the finish is provided with at least one thread of a first type, said thread of the first type being intended to cooperate with the notches of the cap intended to close said container, said thread of the first type comprising, from top to bottom, a first inclined thread segment, a second substantially horizontal thread segment, and a third inclined thread segment, said third thread segment being further provided with an anti-screwing stop. Advantageously, the outer wall of the finish is provided with at least two such diametrically opposed threads of a first type.

In such an embodiment, the first inclined thread segment allows the initiation of the screwing and the progressive crushing of the seal during tightening. In addition, the presence of the anti-screwing stop on the third thread segment makes it possible to prevent excessive tightening of the cap. This is particularly advantageous when the caps are screwed onto the containers in an industrial manner by machines, such as cappers, which apply tightening torques automatically.

In one embodiment, the outer wall of the finish may be provided with at least four such threads of the first type, said four threads of the first type being diametrically opposed in pairs.

In another embodiment of the invention, the outer wall of the finish is provided with at least one thread of a second type, said thread of the second type being intended to cooperate with the notches of the cap intended to close said container, said thread of the second type comprising, from top to bottom, a first inclined thread segment, a second substantially horizontal thread segment, and a third thread segment, said third thread segment being free of anti-screwing stop. The outer wall of the finish may for example be provided with at least two such diametrically opposed threads of the second type. In one embodiment of the invention, the outer wall of the finish may be provided with four threads of the second type, said four threads of the second type being diametrically opposed in pairs.

In one embodiment, the outer wall of the finish may be provided with both threads of the first type and threads of the second type.

In a preferred embodiment, the outer wall of the finish is provided with threads of the second type only.

In one embodiment, the distance from the second horizontal thread segment, of the threads of first type to the top of the ogive of the locking ring has a value k ranging from 4.0 mm to 20.0 mm, preferably from 7.0 mm to 15.0 mm. Such an embodiment makes it possible to adjust the distance from the cap-seal interface to the top of the ogive, in other words to the top of the locking ring of the container according to the invention, when the cap closes the container according to the invention, and thus to adjust the level of compression of the seal, with the same cap. Thus, the length of contact arc is reduced, and the opening torque necessary to be able to open the container is reduced. The opening of the container is thus made easier.

The container according to the invention may be manufactured by known methods for manufacturing glass containers, such as for example the press and blow method or the blow and blow method.

Figure 7:
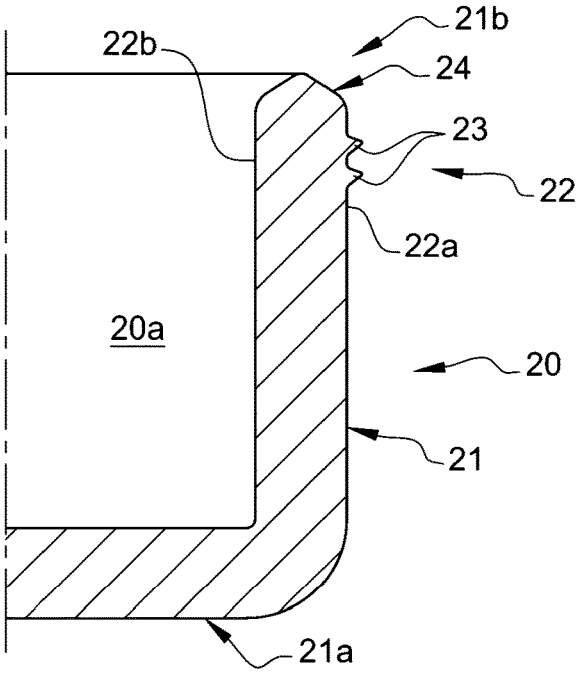
Figure 8:
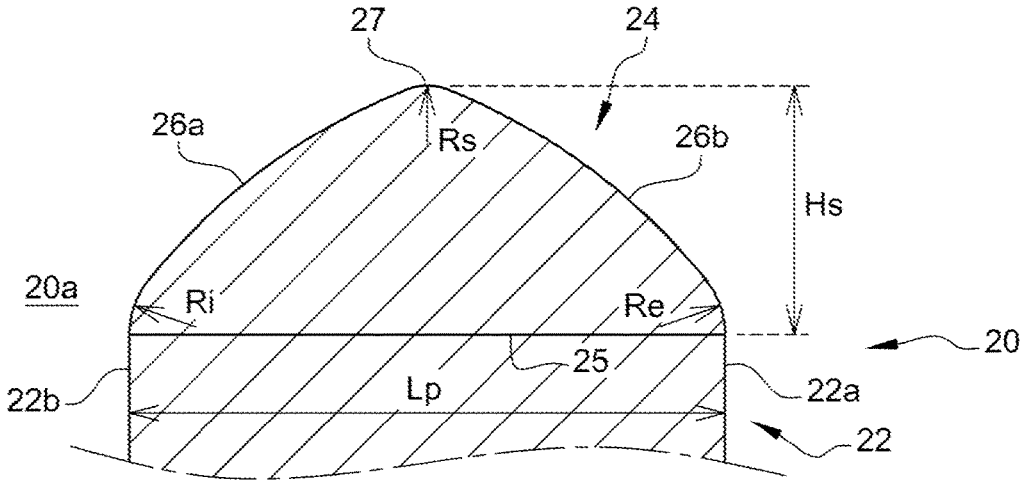
Figure 9:
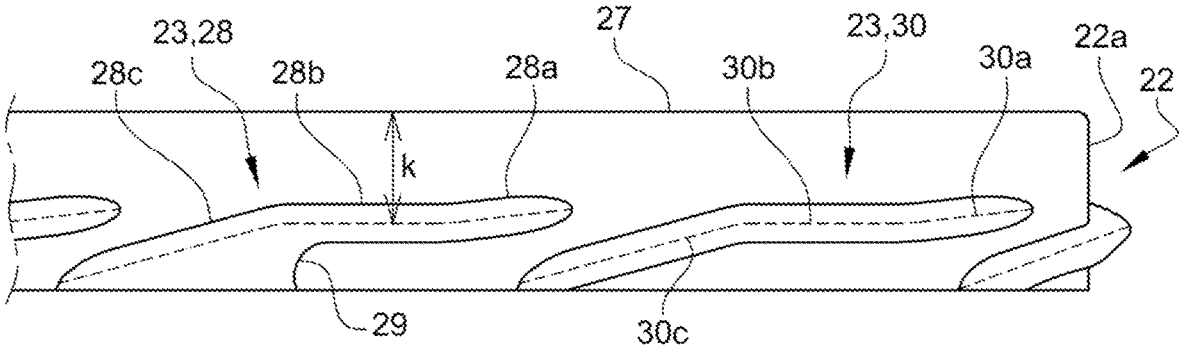
Figure 10:
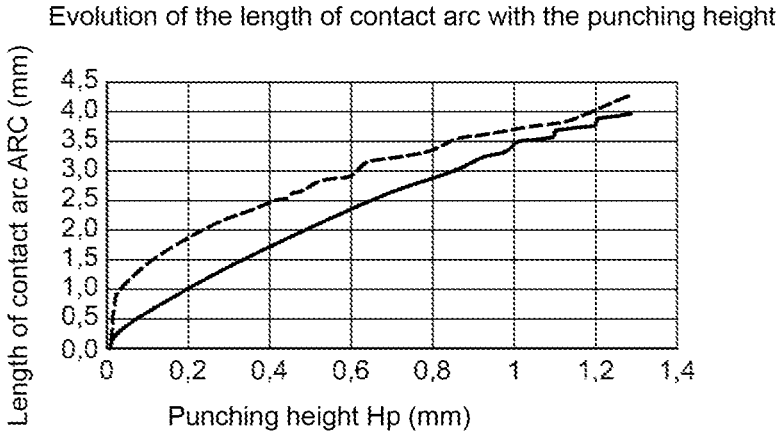
Figure 11:
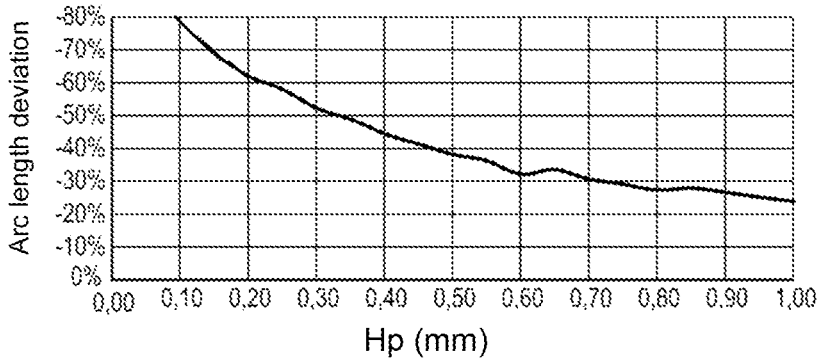

The present invention will emerge more fully from the detailed description which follows accompanied by the drawings in which:

FIG. 1 is a side view of a container of the prior art with a standard locking ring, FIG. 2 is a side view of the container of the prior art of FIG. 1 closed by a notched cap, FIG. 3 is a longitudinal sectional half-view of the container of the prior art of FIG. 1, showing the profile of the standard locking ring, FIG. 4 is a partial view on a larger scale of FIG. 3 showing more precisely the profile of the standard locking ring of the container of the prior art, FIG. 5 is a partial sectional view of a groove of a notched cap with a seal, before use of the cap, FIG. 6 is a partial sectional view of the groove of FIG. 5 after screwing and tightening the cap on the container of the prior art of FIGS. 1-4 and keeping the container thus closed for seven days, FIG. 7 is a sectional view showing an ogive-shaped profile of the locking ring of a container according to the invention, FIG. 8 is a view of FIG. 7 indicating the various possible variable parameters for the ogive-shaped profile of the locking ring of the container according to the invention, FIG. 9 is a side view of a finish of the container according to the invention showing the threads of first type and the threads of second type, FIG. 10 represents the graph of the comparison of the lengths of contact arc measured for a container of the prior art having a standard locking ring (dotted curve) and a container according to the invention having a locking ring having an ogive-shaped profile (solid curve), FIG. 11 represents the graph of FIG. 10 expressed in the form of a contact arc length deviation of the locking ring according to the invention as a percentage relative to the standard locking ring.

With reference to FIG. 7, and to FIG. 8 which is a partial view thereof on a larger scale, a container 20 according to the invention is represented: the container 20 is hollow and is made of glass. It comprises a cylindrical body 21 defining an interior 20*a* of the container 20, having a closed lower end 21*a* forming the bottom of the container 20 and an open upper end 21*b*. The upper end 21*b* is formed of a finish 22 having an outer wall 22*a* provided with threads 23, an inner wall 22*b*, and a locking ring 24 having an ogive-shaped profile. The threads 23 are intended to cooperate with the notches 7 of a cap 6 as described in FIG. 2, intended to be screwed and tightened on the finish 22 to close the container 20.

As shown in FIG. 8, the profile of the locking ring 24 of the container 20 according to the invention defines for the ogive a base 25, a first flank 26*a* located towards the interior 20*a* of the container 20, a second flank 26*b*, located towards the exterior of the container 20, and a top 27. As it appears from this FIG. 8, the base 25 is formed of the horizontal line connecting the place where the first flank 26*a* joins the generally rectilinear profile of the inner wall 22*b* of the finish 22 to the place where the second flank 26*b* joins the generally rectilinear profile of the outer wall 22*a* of the finish 22. As also appears from this FIG. 8, the top 27 is aligned vertically with a point (not shown) which would be located at the center of the base 25. In the example represented, the ogive defined by the profile of the locking ring 24 is a symmetrical ogive. The top 27 has a shape of a circular arc having a radius Rs as indicated in FIG. 8. The top of the ogive is thus free of any flats.

The radius Rs may range from 0.10 to 1.25 mm, preferably from 0.40 to 1.00 mm. For example, Rs may be equal to 0.80 mm.

The base 25 of the ogive may have a width Lp ranging from 1.0 mm to 10.0 mm, preferably from 2.0 mm to 6.0 mm.

The height Hs of the ogive, from the base 25 to its top 27, may range from 0.5 mm to 5 mm, preferably from 1.0 mm to 3.0 mm.

The first flank 26*a* of the ogive, located towards the interior 20*a* of the container 20, joins the generally rectilinear profile of an inner wall 22*b* of the finish 22 according to a circular arc having a radius Ri. The radius Ri may range from 0.10 mm to 1.25 mm, preferably ranging from 0.40 mm to 1.00 mm.

The second flank 26*b* of the ogive, located towards the exterior of the container 20, joins the generally rectilinear profile of the outer wall 22*a* of the finish 22 according to a circular arc having a radius Re. The radius Re may range from 0.10 mm to 1.25 mm, preferably ranging from 0.40 mm to 1.00 mm.

In an embodiment not represented, the ogive defined by the profile of the locking ring 24 could be asymmetrical, the top 27 of the ogive being offset in the direction of the interior 20*a* of the container 20 with respect to a point located at the center of the base 25 of the ogive. Such an embodiment has the advantage of more easily controlling the reflux of material from the seal of the cap closing the container 20 during storage of the container 20 closed.

With reference to FIG. 9, the threads 23 of the finish 22 of the container 20 are described more precisely. The threads 23 comprise threads of first type 28. Each thread of first type 28 comprises from top to bottom, as shown in FIG. 8, a first inclined thread segment 28*a*, a second substantially horizontal thread segment 28*b*, and a third inclined thread segment 28*c*. The third thread segment 28*c* is provided with an anti-screwing stop 29. The first inclined thread segment 28*a* allows the initiation of the screwing and the progressive crushing of the seal 9 of the cap 6 during tightening. In addition, the presence of the anti-screwing stop 29 on the third thread segment 28*c* makes it possible to prevent excessive tightening of the cap 6. For example, the first thread segments 28*a* may have an angle of inclination, relative to a horizontal line, of around 6.3°. The length of these first thread segments 28*a*, on the circumference of the circular outer wall 22*a* of the finish 22, may for example be approximately 12°.

The length of the second thread segments 28*b*, on the circumference of the circular outer wall 22*a* of the finish 22, may for example be approximately 22°.

The threads of first type 28 may be present on the circumference of the outer wall 22*a* of the finish 22 in the number of at least one, even two, four, six or more, diametrically opposed in pairs.

The threads 23 also comprise threads of second type 30. Each thread of second type 30 comprises, from top to bottom, a first inclined thread segment 30*a*, a second substantially horizontal thread segment 30*b*, and a third thread segment 30*c*, said third thread segment 30*c* being free of anti-screwing stop.

The threads of second type 30 may for example be present on the circumference of the outer wall 22*a* of the finish 22, two in number.

In one embodiment, the finish 22 is provided with a total of six threads 23, for example four threads of first type 28 and two threads of second type 30.

In one embodiment, the finish is only provided with threads of the second type.

The threads of first type 28 and/or of second type 30 make it possible to limit the tightening of the cap 6 on the container when the container 20 is closed.

The evolution of the length of contact arc as defined above was measured for a locking ring 24 according to the invention and was compared with that of a standard locking ring 5 as shown in FIG. 4.

The profile of the locking ring 24 of the container 20 according to the invention had the ogive shape shown in FIG. 8 with the following dimensions:

Rs=0.80 mm
Ri=0.80 mm
Re=0.80 mm
Lp=2.5 mm
Hs=1 mm
k=7.55 mm

The profile of the standard locking ring 5 had the shape shown in FIG. 4.

The containers 20 according to the invention and the containers 1 of the prior art were closed by caps 6 with notches 7 as shown in FIG. 2. The seal 9 was a standard PVC cast seal.

The caps were screwed and tightened using a capper with an identical tightening torque for all the containers.

The lengths of contact arc were calculated after taking the profile by a measuring instrument "MarTalk" from the Mahr company with the following parameters:

Drive unit: DriveUnit.PCV feeler: PCV 350×33 mm #1632/99

Rate of progression: 1000 mm/s

FIG. 10 shows the evolution of the length of contact arc (Arc) as a function of the punching height (Hp) for the containers 1 of the prior art having a standard locking ring 5 (dotted curve) and for the containers 20 according to the invention having the locking ring 24 (solid curve). As it appears from this figure, the containers 20 according to the invention make it possible to significantly reduce the length of contact arc between the locking ring 24 and the seal 9 of the cap 6. Thus, the opening torque that it is necessary to exert in order to be able to open the containers 20 according to the invention is significantly less important than that which it is necessary to exercise to open the containers 1 of the prior art.

FIG. 11 repeats the graph of FIG. 10 by expressing it in the form of a contact arc length deviation of the locking ring 24 of the containers 20 according to the invention as a percentage relative to the standard locking ring 5 of the containers 1 of the prior art. As it appears from this Figure, it is possible, thanks to the locking ring 24 of the containers 20 according to the invention, to reduce the lengths of contact arc by 27 to 60% respectively for punching heights Hp commonly between 0.2 mm and 0.9 mm. For example, at a punching height Hp of 0.5 mm, the length of contact arc may be reduced by 38% compared to the containers 1 of the prior art.

The reductions in length of contact arc obtained with the locking ring 24 of the containers 20 according to the invention make it possible to significantly reduce the value of the opening torque necessary to be able to open the containers 20 after screwing, capping and storage. For example, the opening torque may be reduced by at least 10%, preferably by at least 15%, and for example up to 36%, with the locking ring 24 of the container 20 according to the invention.

The containers according to the invention thus have the advantage of being able to both preserve food in a sealed and safe manner for significant periods, while having an easy opening. In particular, the containers according to the invention may be opened by people with little strength in their hands or by elderly.

The invention claimed is:

1. A glass hollow container comprising:

a finish intended to cooperate with a cap to close the container, wherein:

the finish has a locking ring whose cross section has a profile substantially in a shape of an ogive, the profile of the ogive has a base having a center, two flanks, and a top, the top is connected at both sides with the two flanks, the top has a convex circular surface and each flank of the two flanks has a substantially rectilinear or convex surface, the top is aligned with a point located at the center of the base or offset in a direction of an interior of the container with respect to the point located at the center of the base, and the top has a shape of a circular arc having a radius Rs ranging from 0.10 to 1.25 mm.

2. The container according to claim 1, wherein Rs is equal to 0.80 mm.

3. The container according to claim 1, wherein the base of the ogive has a width Lp ranging from 1.0 mm to 10.0 mm.

4. The container according to claim 1, wherein a height Hs of the ogive, from the base to its top, ranges from 0.5 mm to 5 mm.

5. The container according to claim 1, wherein a flank of the two flanks located towards the interior of the container joins a generally rectilinear profile of an inner wall of the finish according to a circular arc having a radius Ri ranging from 0.10 mm to 1.25 mm.

6. The container according to claim 1, wherein a flank of the two flanks located towards an exterior of the container joins a generally rectilinear profile of an outer wall of the finish according to a circular arc having a radius Re ranging from 0.10 mm to 1.25 mm.

7. The container according to claim 1, wherein an outer wall of the finish is provided with at least one thread of a first type, the thread of the first type being intended to cooperate with the cap intended to close the container, the thread of the first type comprising, from top to bottom, a first inclined thread segment, a second substantially horizontal thread segment, and a third inclined thread segment, the third thread segment being further provided with an anti-screwing stop.

8. The container according to claim 7, wherein the outer wall of the finish is provided with at least two such diametrically opposed threads of a first type.

9. The container according to claim 7, wherein the outer wall of the finish is provided with at least four such threads of the first type, the four threads of the first type being diametrically opposed in pairs.

10. The container according to claim 1, wherein an outer wall of the finish is provided with at least one thread of a second type, the thread of the second type being intended to cooperate with the cap intended to close the container, the thread of the second type comprising, from top to bottom, a first inclined thread segment, a second substantially horizontal thread segment, and a third thread segment, third thread segment being free of anti-screwing stop.

11. The container according to claim 10, wherein the outer wall of the finish is provided with at least two such diametrically opposed threads of the second type.

12. The container according to claim 10, wherein the outer wall of the finish is provided with at least four such threads of the second type, the four threads of the second type being diametrically opposed in pairs.

13. The container according to claim 7, wherein the distance from the second horizontal thread segment of the threads of first type to the top of the ogive of the locking ring has a value k ranging from 4.0 mm to 20.0 mm.

* * * * *